US005359757A

United States Patent [19]

Yamakita

[11] Patent Number: 5,359,757

[45] Date of Patent: Nov. 1, 1994

[54] METHOD AND APPARATUS FOR TREATING A BELT-LIKE ARTICLE

[75] Inventor: Yoshimichi Yamakita, Toyama, Japan

[73] Assignee: Yoshida Kogyo K.K., Tokyo, Japan

[21] Appl. No.: 56,541

[22] Filed: May 5, 1993

[30] Foreign Application Priority Data

May 15, 1992 [JP] Japan ..... 4-123006

[51] Int. Cl.[5] ..... D06B 3/22

[52] U.S. Cl. ..... 28/167; 34/68; 34/78; 354/321; 226/119

[58] Field of Search ..... 28/167; 354/319, 321; 226/104, 105, 106, 107, 119; 314/68, 78, 86, 203, 219

[56] References Cited

U.S. PATENT DOCUMENTS

| | | | |
|---|---|---|---|
| 1,890,026 | 12/1932 | Barkelew | 226/119 X |
| 2,169,061 | 8/1939 | Tondreau | 226/119 X |
| 2,319,809 | 5/1943 | Francis, Jr. | 28/167 X |
| 2,701,717 | 2/1955 | Morrill | 271/23 |
| 2,712,683 | 7/1955 | Gaunt et al. | 28/167 X |
| 2,914,999 | 12/1959 | Jamieson | 354/321 |
| 3,724,355 | 4/1973 | Busch et al. | 354/319 X |
| 3,905,059 | 9/1975 | Stanway | 8/151.1 |
| 4,590,683 | 5/1986 | Magin | 34/68 X |
| 4,756,091 | 7/1988 | Van Denend | 34/68 X |
| 4,785,552 | 11/1988 | Best | 34/68 X |
| 4,813,440 | 3/1989 | Johnson et al. | 34/78 X |

FOREIGN PATENT DOCUMENTS

| | | |
|---|---|---|
| A 811369 | 4/1959 | United Kingdom . |
| 2030183 A | 4/1980 | United Kingdom . |
| 2140051 A | 11/1984 | United Kingdom . |

*Primary Examiner*—Clifford D. Crowder
*Assistant Examiner*—John J. Calvert
*Attorney, Agent, or Firm*—Hill, Steadman & Simpson

[57] ABSTRACT

A method of treating a continuously travelling belt-like article with various processes in a tightly closed treatment chamber, comprising the steps of: introducing the belt-like article horizontally into the treatment chamber; guiding the introduced belt-like article up and down in a meandering path between an upper guide roller and a number of successive drive rollers in the treatment chamber while the belt-like article is being treated with the various processes, the guiding including firstly directing the belt-like article upwards via the first drive roller, twisting the belt-like article by 90° in one direction, winding the belt-like article around the upper guide roller, then directing the belt-like article downwards and winding around the second drive roller, secondly directing the belt-like article upwards again, twisting the belt-like article by 90° in a direction opposite to the one direction, winding around the guide roller, then directing the belt-like article downwards and winding around the third drive roller, and repeating the same sequentially in connection with the subsequent drive rollers; and discharging the treated belt-like article horizontally out of the treatment chamber.

7 Claims, 2 Drawing Sheets

METHOD AND APPARATUS FOR TREATING A BELT-LIKE ARTICLE

BACKGROUND OF THE INVENTION

1. Field of the Invention

This invention relates to a method of and an apparatus for treating a belt-like article with various finishing processes, and more particularly to a belt-like article treating method and apparatus in which only one surface of a continuously travelling belt-like article is guided by a guide member, an adequate length of travelling path of the belt-like article can be secured, the tension of the belt-like article can be adjusted to a proper value, and the cost of production can be reduced with simple construction.

2. Description of the Related Art

In the dyeing process, a cloth product, which is made of a knit, woven or non-woven cloth of natural fibers, i.e. cellulose fibers or protein fibers, semi-synthetic fibers, or synthetic fibers of ester, polyamide or other group, is usually treated by various finishing processes, e.g. steaming, refining (bleaching), dyeing, cleaning and desizing, individually or in combination.

The foregoing finishing processes take place sometimes batchwise in a high-pressure tank, but practically they are carried out continuously in and along a tightly closed treatment chamber. During this continuous processing, the travelling cloth is guided up and down in a meandering path in the treatment chamber between upper and lower rows of guide rollers as merely wound sequentially therearound under a predetermined tension or in a tensionless state, as disclosed in, for example, Japanese Patent Publication No. Sho 47-21276, thus taking a long travel within the treatment chamber.

However, in the conventional guiding method, the guide rollers contact both the front and back surfaces of the cloth; if the cloth is a surface fastener having a multiplicity of hooks or loops on one surface or an ordinary knit or woven cloth having loops on opposite surfaces, the hooks and loops are squeezed out of shape as the hooked and looped surfaces are pressed against the guide rollers, deteriorating the commercial value.

Attempts have therefore been made to keep one surface of the cloth out of contact with the guide rollers while the cloth is travelling in the treatment chamber as guided by the guide rollers. In a guiding method as disclosed in, for example, Japanese Patent Publications Nos. Sho 49-26107 and Sho 47-42540 and Japanese Utility Model Laid-Open Publication No. Sho 52-128786, a belt-like article is sequentially carried by a row of conveyor rollers arranged horizontally in an upper part of the treatment chamber in a tensionless state, slouching between the successive conveyor rollers, with only one surface of the belt-like article in contact with the conveyor rollers.

In another guiding method as disclosed in, for example, Japanese Patent Publication No. Sho 56-38704, a belt-like article is sequentially carried by a large number of guide rollers arranged spirally in a treatment chamber, while the belt-like article is being guided in and along the treatment chamber from one end to the other. In this guiding method, like the method mentioned in the previous paragraph, only one surface of the continuously travelling belt-like article contacts the guide rollers so that the hooks and loops are prevented from being squeezed out of shape by the guide rollers.

In the guide method of Japanese Patent Publication No. Sho 49-26107, in which the belt-like article is guided in a partly slouching state, since it can be processed only in a tensionless state, the belt-like article tends to shrink as processed and requires a very complicated control to synchronize the rate of paying out the belt-like article with the rate of taking it up.

With the guide method of Japanese Patent Publication No. Sho 56-38704, in which the belt-like article is guided in a spiral path, it is advantageous in giving a predetermined tension to the belt-like article, but it requires a complex guide mechanism, which is expensive.

SUMMARY OF THE INVENTION

It is therefore an object of this invention to provide a method of and an apparatus for treating a belt-like article simply and inexpensively, securing an adequately long travelling path in a treatment chamber and enabling a proper tension adjustment.

According to one aspect of the invention, there is provided a method of treating a continuously travelling belt-like article with various processes in a tightly closed treatment chamber, comprising the steps of: introducing the belt-like article horizontally into the treatment chamber; guiding the introduced belt-like article up and down in a meandering path between an upper guide roller and a number of successive drive rollers in the treatment chamber while the belt-like article is being treated with the various processes, the lower rollers are aligned along a vertical plane parallel to an axis of the upper roller, the guiding including firstly directing the belt-like article upwards via the first drive roller, twisting the belt-like article by 90° in one direction, winding the belt-like article around the upper guide roller, then directing the belt-like article downwards and winding around the second drive roller, secondly directing the belt-like article upwards again, twisting the belt-like article by 90° in a direction opposite to the one direction, winding around the guide roller, then directing the belt-like article downwards and winding around the third drive roller, and repeating the same sequentially in connection with the subsequent drive rollers; and discharging the treated belt-like article horizontally out of the treatment chamber.

According to another aspect of the invention, there is provided an apparatus for treating a continuously travelling belt-like article with various processes in a tightly closed treatment chamber having inlet and outlet ports through which the belt-like article is to be introduced into and discharged from the treatment chamber, the apparatus comprising: a guide roller rotatably mounted in an upper part of the treatment chamber and horizontally extending along the path of travel of the belt-like article; and a plurality of drive roller mounted in a lower part of the treatment chamber perpendicularly to the guide roller and horizontally arranged along the path of travel of the belt-like article; wherein the belt-like article introduced horizontally into the treatment chamber from the inlet port is guided up and down in a meandering path between the guide roller and the successive drive rollers, the belt-like article being twisted by 90° alternately in opposite directions between the individual drive rollers and the guide roller so as to come into contact at only one surface with the individual guide and drive rollers.

Preferably, there may be mounted, in the treatment chamber, cleaning means, steaming means, and drying means. The cleaning means may include a shower nozzle unit situated near the guide roller, an ultrasonic vibrator situated near the guide roller, and a suction pipe situated between the individual drive rollers. The steaming means may be equipped with an automatic water supply unit and includes a reboiling tank with a built-in heater. The drying means may include a hot air blowing nozzle unit situated in the treatment chamber for applying hot air to the belt-like article and associated with a fan, a heater and a shutter, which are all situated outside the treatment chamber.

The cloth is guided up and down in a meandering path sequentially between the upper guide roller and the successive lower drive rollers, while the cloth is twisted by 90° alternately in opposite directions between the individual drive rollers and the guide roller. As a result, the cloth is positively moved forwardly under a predetermined tension by the drive rollers.

When dyeing a rayon woven article, a dye fixer is applied to the rayon woven article in the preparation process and then shower washing takes place, whereupon an anti-spread agent and a dye accelerator are applied to the article. Then the resulting article is introduced into a treatment chamber where the article travels in a meandering path, with only its one surface in contact with the drive rollers and the guide roller as described above.

Inside the treatment chamber, the hot air blowing dryer and a reboiling tank operate concurrently and it is normally kept at about 103° C. and, also at the same time, color development takes place by steaming. Upon completion of the color development, the rayon woven article will be discharged out of the treatment chamber via a water-seal tank.

With the cloth treating apparatus of this invention, it is possible to wash the thus dyed rayon woven article. Namely, since the shower nozzle, the ultrasonic vibrator and the suction pipe are situated in the upper part of the treatment chamber, it is possible to perform, on the rayon woven article travelling up and down in a meandering path, shower washing with vibration at the upper side of the chamber and concurrently washing water removal by suction at the lower side of the chamber. Then the rayon woven article will be discharged out of the treatment chamber via the water-seal tank. This apparatus may be used for only drying, in which event water should be removed from the water-seal tank.

Further, with the cloth treating apparatus, if the treatment chamber is charged with drying atmosphere, a synthetic fiber cloth using, for example, polyester fibers or polyamide fibers can be treated by dyeing and other processes.

DETAILED DESCRIPTION

A typical embodiment of this invention will now be described in detail with reference to the accompanying drawings.

Figure 1:
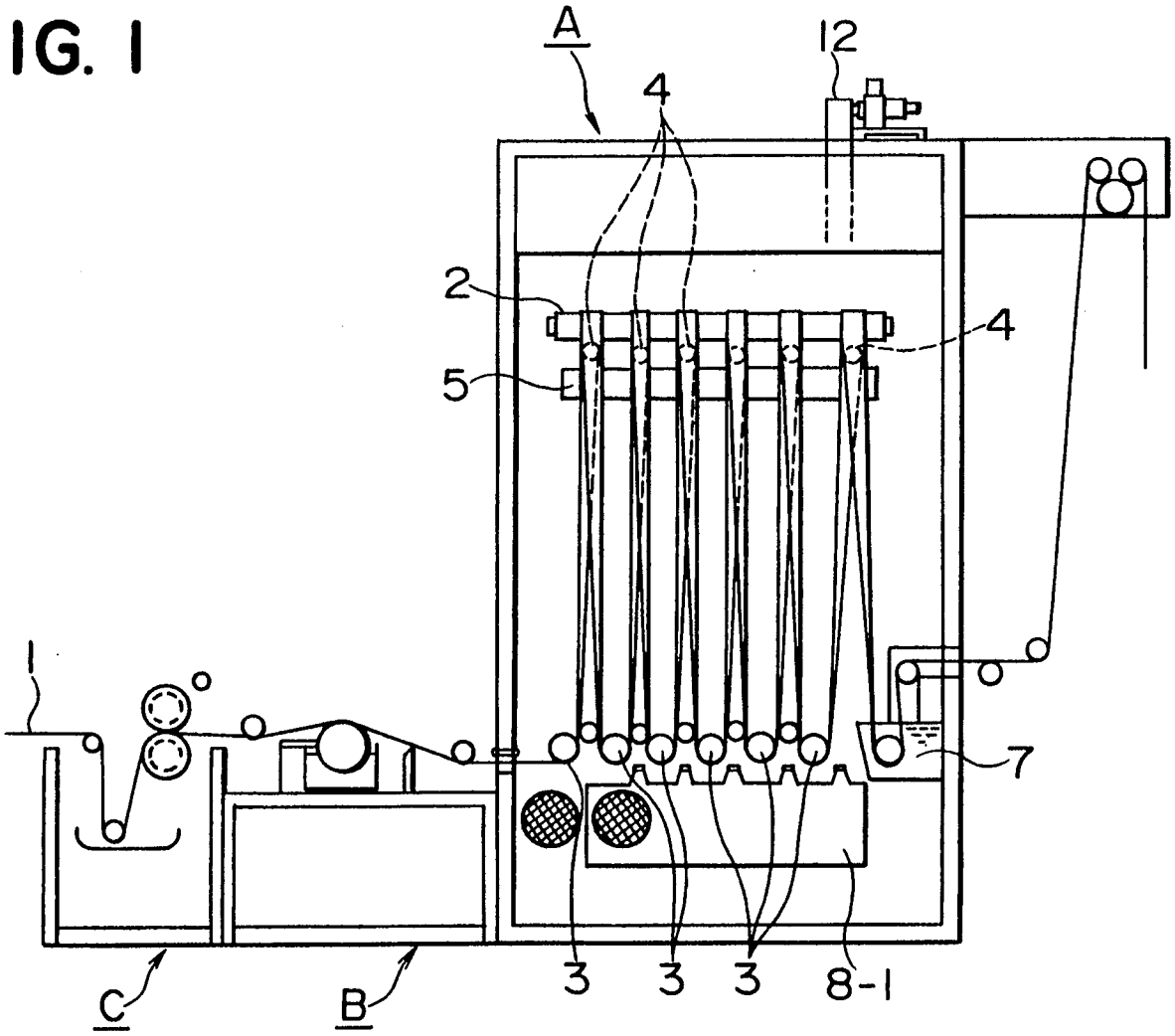
FIG. 1 is an opened-up side view showing the interior of a belt-like article treating apparatus according to a typical embodiment of this invention.
Figure 2:
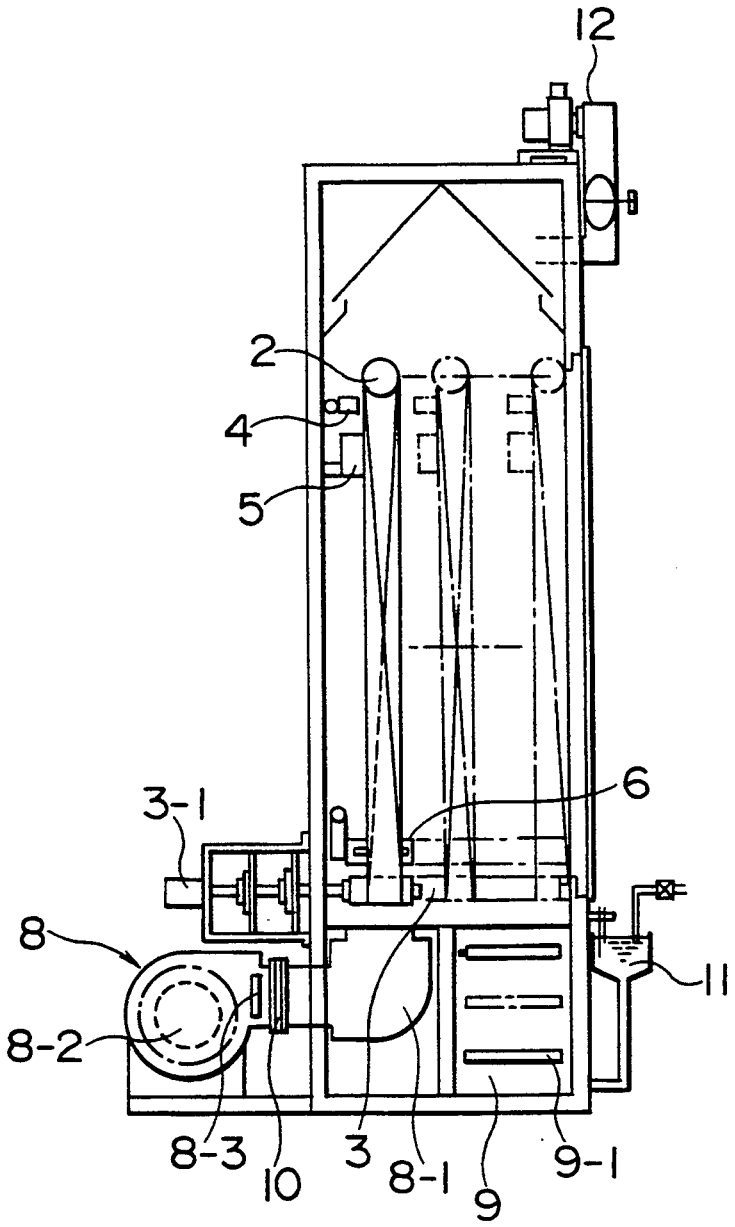
FIG. 2 is an opened-up front view showing the interior of the apparatus of FIG. 1.

FIGS. 1 and 2 show a cloth treating apparatus according to a preferred embodiment of the invention; FIG. 1 is an opened-up side view showing the interior of the treating apparatus, and FIG. 2 is a front view corresponding to FIG. 1. In this embodiment, the treatment apparatus is capable of performing various processes, for example, drying (heat setting, color development), washing with water, steam-heating (color development).

The cloth treating apparatus of the illustrated embodiment comprises a treatment chamber A, a coating unit B situated upstream of the treatment chamber A adjacent thereto, and a padding mangle unit C situated upstream of the coating unit B adjacent thereto.

Inside the treatment chamber A at its upper central position, a freely rotatable guide roller 2 is mounted horizontally along the path of travel of a cloth 1, and a number of drove rollers 3 situated downwardly of the guide roller 2 perpendicularly thereto and arranged horizontally in parallel relationship with one another. The drive rollers 3 are driven by a power-controlled torque motor 3-1 mounted outside the treatment chamber A so that the tension of the cloth 1 can be automatically adjusted.

Immediately downwardly of the guide roller 2, a number of shower nozzles 4 are mounted facing towards the surface of travel of the cloth 1, and also a single ultrasonic vibrator 5 is horizontally mounted facing in the same direction. Between each adjacent pair of drive rollers 3, 3, a suction pipe 6 having in its opposite side surfaces a pair of suction openings is located. The last one of the successive drive rollers 3 is situated inside the water-seal tank 7.

The cloth 1 introduced horizontally into the treatment chamber A from an inlet port located on the underside of the chamber A is wound on the first drive roller 3 from its lower side, is directed upwards, is twisted anticlockwise by 90°, is wound on the guide roller 2 from its upper side, and is then turned perpendicularly downwards. After this downward turn, the cloth 1 is twisted clockwise by 90°, is wound on the second drive roller 3 from its lower side, is directed perpendicularly upwards, is twisted anticlockwise by 90°, and is then wound on the guide roller 2. Likewise, the cloth 1 is sequentially wound on the third and fourth drive rollers 3, and so forth, and finally the cloth 1 is discharged out of the treatment chamber A from an outlet port located on the underside of the chamber A via the water-seal tank 7.

Inside the treatment chamber A at its lower part, a hot air blowing dryer 8 having a number of blowing nozzles 8-1 facing the respective inter-roller spaces of the drive rollers 3 is mounted. A reboiling tank 9 having a built-in heater 9-1 is mounted by the side of the hot air blowing dryer 8. The hot air blowing dryer 8 has a fan 8-2 mounted outside of the treatment chamber A and connected to the blowing nozzles 8-1 via a heater 8-3 and a shutter 10. The reboiling tank 9 is connected to an automatic water supply unit 11 mounted outside the treatment chamber A. An exhaust means 12 is mounted upwardly outside the treatment chamber A and is connected thereto via a duct.

Both the coating unit B situated upstream of the treatment chamber A and the padding mangle unit C situated upstream of the coating unit B are of the conventional type; they are similar in construction to those of the conventional art and so their detailed description is omitted here for clarity.

In the illustrated embodiment, only a single guide roller 2 is mounted in the treatment chamber. Alternatively, a plurality of guide roller may be mounted as indicated by phantom lines in FIG. 2; in such event, each drive roller 3 should be set up as long as the entire row of guide rollers 2, and should be rotatably supported at opposite ends.

The operation of this cloth treating apparatus will now be described. The cloth 1 is guided up and down in a meandering path in the treatment chamber A while it is twisted by 90° alternately in opposite directions between the upper guide roller 2 and the individual lower drive rollers 3. The cloth 1 is positively conveyed forwards under a predetermined tension sequentially by the successive drive rollers 3.

When dyeing, for example, a rayon woven article, a dye fixer is applied to the rayon woven article 1 in the padding mangle unit C of the preparation step and then shower washing takes place, whereupon an anti-spread agent and a dye accelerator are applied to the article 1 in the coating unit B of the next step. Then the resulting article is introduced into the treatment chamber A, which is the main part of this treatment apparatus, where the article 1 travels in a meandering path, with only its one surface in contact with the drive rollers 3 and the guide roller 2 as described above.

Inside the treatment chamber A, the hot air blowing dryer 8 and the reboiling tank 9 operate concurrently and it is normally kept at about 103° C. and, also at the same time, color development takes place by steaming. Upon completion of the color development, the rayon woven article will be discharged out of the treatment chamber via the water-seal tank 7.

The thus dyed rayon woven article may be washed by this treating apparatus. Namely, since the shower nozzles 4, the ultrasonic vibrator 5 and the suction pipe 6 are situated in the upper part of the treatment chamber A, it is possible to perform, on the rayon woven article 1 travelling up and down in a meandering path, shower washing with vibration at the upper side of the chamber A and concurrently washing water removal by suction at the lower side of the chamber A. Then the rayon woven article 1 will be discharged out of the treatment chamber A via the water-seal tank 7.

In the foregoing embodiment, the objective of dyeing was a rayon woven article, and the treatment chamber A was charged with steam-drying atmosphere. According to this treating apparatus, it is also possible to treat a synthetic fiber cloth using, for example, polyester fibers or polyamide fibers with various processes.

For example, when dyeing a cloth of polyester fibers, a dye is attached to the cloth 1 in the padding mangle unit C of the preparation step, and then the cloth 1 is introduced into the treatment chamber A. At that time, as the hot air blowing dryer 8 operates, the cloth 1 is dry heated at about 200° C. to develop color while it travels in the treatment chamber A. The color-developed cloth 1 is then treated with reducing and washing, which processes may be carried out using the treating apparatus of this invention. Specifically, as the shower nozzles 4, the ultrasonic vibrator 5 and the suction pipe 6 in the treatment chamber A are operated, the polyester fiber cloth 1 color-developed with the reducer in the padding mangle unit C is washed while travelling in the treatment chamber A.

Since the treating apparatus of this invention is equipped with various kinds of built-in treatment units for various processes, a desired process can be carried out as selected such as by a non-illustrated switch.

As is apparent from the foregoing description, according to the belt-like article treating apparatus of this invention, since only one surface of the belt-like article contacts the guide members while the belt-like article travels in the treatment chamber, no pressure will be exerted on the other surface of the belt-like article so that this non-contact surface would be kept from being deformed or damaged. Further, since an adequate length of travelling path is secured, an amount of treated belt-like article can be increased comparing to the conventional one in a certain volume of treatment chamber, and the tension of the belt-like article can be adjusted properly. Further, the treatment apparatus is simple in structure and is hence low in cost of production, and various processes can be carried out using one and the same apparatus.

What is claimed is:

1. A method of treating a continuously travelling belt-like article with various processes in a tightly closed treatment chamber, comprising the steps of:

(a) introducing the belt-like article horizontally into said treatment chamber; p1 (b) guiding the introduced belt-like article up and down in a meandering path between an upper roller and a number of successive lower rollers in said treatment chamber while the belt-like article is being treated with the various processes, said lower rollers aligned along a vertical plane parallel to an axis of the upper roller said guiding including firstly directing the belt-like article upwards via said first lower roller, twisting the belt-like article by 90° in one direction, winding the belt-like article around said upper roller, then directing the belt-like article downwards and winding around a second lower roller, secondly directing the belt-like article upwards again, twisting the belt-like article by 90° in a direction opposite to said one direction, winding around said upper roller, then directing the belt-like article downwards and winding around a third lower roller; and (c) discharging the treated belt-like article horizontally out of said treatment chamber.

2. An apparatus for treating a continuously travelling belt-like article with various processes in a tightly closed treatment chamber having inlet and outlet ports through which the belt-like article is to be introduced into and discharged from said treatment chamber, said apparatus comprising:

an upper roller rotatably mounted in an upper part of said treatment chamber and horizontally extending along a path of travel of the belt-like article; and a plurality of lower rollers mounted in a lower part of said treatment chamber perpendicularly to said upper roller and horizontally arranged along the path of travel of the belt-like article, said lower rollers aligned along a vertical plane parallel to an axis of the upper roller wherein the belt-like article introduced horizontally into said treatment chamber from said inlet port is guided up and down in a meandering path between said upper roller and said successive lower rollers, the belt-like article being twisted by 90° alternately in opposite directions between said individual lower rollers and said upper roller so as to come into contact at only one surface with said individual upper and lower rollers.

3. A belt-like article treating apparatus according to claim 2, wherein said upper roller is a guide roller which is freely rotatable, and wherein said lower rollers are drive rollers which are rotated by a drive means.

4. A belt-like article treating apparatus according to claim 2, wherein there are mounted, in said treatment chamber, cleaning means, steaming means, and drying means.

5. An apparatus for treating a continuously travelling belt-like article with various processes in a tightly closed treatment chamber having inlet and outlet ports through which the belt-like article is to be introduced into and discharged from said treatment chamber, said apparatus comprising:

an upper roller rotatably mounted in an upper part of said treatment chamber and horizontally extending along a path of travel of the belt-like article; and a plurality of lower rollers mounted in a lower part of said treatment chamber perpendicularly to said upper roller and horizontally arranged along the path of travel of the belt-like article;

wherein the belt-like article introduced horizontally into said treatment chamber from said inlet port is guided up and down in a meandering path between said upper roller and said successive lower rollers, the belt-like article being twisted by 90° alternately in opposite directions between said individual lower rollers and said upper roller so as to come into contact at only one surface with said individual upper and lower rollers;

wherein there are mounted, in said treatment chamber, cleaning means, steaming means, and drying means; and wherein said cleaning means includes a shower nozzle unit situated near said upper roller, an ultrasonic vibrator situated near said upper roller, and a suction pipe situated between said individual lower rollers.

6. A belt-like article treating apparatus according to claim 4, wherein said steaming means is equipped with an automatic water supply unit and includes a reboiling tank with a built-in heater.

7. A belt-like article treating apparatus according to claim 4, wherein said drying means includes a hot air blowing nozzle unit situated in said treatment chamber for applying hot air to the belt-like article and associated with a fan, a heater and a shutter, which are all situated outside said treatment chamber.

* * * * *